US012416132B2

(12) United States Patent
Geng et al.

(10) Patent No.: US 12,416,132 B2
(45) Date of Patent: Sep. 16, 2025

(54) BACKHOE LOADER WITH 360° PLATFORM FOR EFFICIENT DIGGING

(71) Applicant: JIANGSU XCMG CONSTRUCTION MACHINERY RESEARCH INSTITUTE LTD., Jiangsu (CN)

(72) Inventors: Yanbo Geng, Jiangsu (CN); Xiaocheng Liu, Jiangsu (CN); Weiwei Jin, Jiangsu (CN)

(73) Assignee: JIANGSU XCMG CONSTRUCTION MACHINERY RESEARCH INSTITUTE LTD., Jiangsu (CN)

( * ) Notice: Subject to any disclaimer, the term of this patent is extended or adjusted under 35 U.S.C. 154(b) by 0 days.

(21) Appl. No.: 17/769,820

(22) PCT Filed: Dec. 31, 2021

(86) PCT No.: PCT/CN2021/143553
§ 371 (c)(1),
(2) Date: Apr. 18, 2022

(87) PCT Pub. No.: WO2022/237201
PCT Pub. Date: Nov. 17, 2022

(65) Prior Publication Data

US 2024/0133155 A1 Apr. 25, 2024
US 2024/0229416 A9 Jul. 11, 2024

(30) Foreign Application Priority Data

Nov. 26, 2021 (CN) ..... 202111424260.8

(51) Int. Cl.
*E02F 9/08* (2006.01)
*E02F 3/38* (2006.01)
(Continued)

(52) U.S. Cl.
CPC ..... *E02F 9/0841* (2013.01); *E02F 3/384* (2013.01); *E02F 9/121* (2013.01); *E02F 9/166* (2013.01)

(58) Field of Classification Search
CPC . E02F 9/121; E02F 9/166; E02F 3/384; E02F 9/0841
See application file for complete search history.

(56) References Cited

U.S. PATENT DOCUMENTS 5,265,995 A * 11/1993 Beck ..... E02F 3/964 280/765.1
5,295,318 A 3/1994 Schaeff
(Continued)

FOREIGN PATENT DOCUMENTS

CN 1711398 A 12/2005
CN 2745999 Y 12/2005
(Continued)

OTHER PUBLICATIONS

English Translation of International Search Report and Written Opinion mailed on Sep. 7, 2022 for International Patent Application PCT/CN2021/143553 (7 pages).
(Continued)

*Primary Examiner* — Joseph M Rocca
*Assistant Examiner* — Julia C Tran
(74) *Attorney, Agent, or Firm* — Merchant & Gould P.C.

(57) ABSTRACT

The backhoe loader includes: a vehicle body, including a first vehicle body and a second vehicle body which are connected sequentially; a loading device, arranged on the first vehicle body; a control platform, arranged on the second vehicle body and configured to rotate by 360° relative to the second vehicle body; a cab, arranged on a first side of the control platform; and an excavating device, arranged on a second side of the control platform opposite to the first side,
(Continued)

the excavating device being configured to rotate by 180° relative to the cab. The backhoe loader can realize functions of 360° excavating and bidirectional driving. When the excavating device works, the backhoe loader can be directly moved by folding stabilizers and without changing the position of a seat back and forth, so that the excavating efficiency is improved.

13 Claims, 4 Drawing Sheets

(51) Int. Cl.
*E02F 9/12* (2006.01)
*E02F 9/16* (2006.01)

(56) References Cited

U.S. PATENT DOCUMENTS

2005/0169738 A1 8/2005 Holt
2006/0150447 A1* 7/2006 Bates ..... E02F 3/28 37/443
2008/0289227 A1* 11/2008 McKee ..... E02F 3/386 37/410
2008/0292442 A1* 11/2008 McKee ..... E02F 9/2012 414/694
2009/0282709 A1* 11/2009 Fukaya ..... E02F 9/121 37/403
2016/0122972 A1* 5/2016 Price ..... E02F 3/325 180/312

FOREIGN PATENT DOCUMENTS

CN 101311430 A 11/2008
CN 106436790 A 2/2017
CN 107630480 A 1/2018
CN 210766941 U 6/2020
EP 0524490 A1 1/1993
EP 1997962 A2 12/2008
EP 1560987 B1 4/2013

OTHER PUBLICATIONS

Office Action issued on Nov. 5, 2024 for Brazilian Application No. BR112022010513-4 (4 pages including Search Report).
Extended European Search Report dated Feb. 4, 2024 for corresponding EP Application No. 21878764.6 (7 pages).
Chinese Office Action for CN Application No. 202111424260.8 mailed May 24, 2022 (7 pages).

* cited by examiner

BACKHOE LOADER WITH 360° PLATFORM FOR EFFICIENT DIGGING

CROSS-REFERENCE TO RELATED APPLICATIONS

This application is a U.S. National Stage Application of PCT/CN2021/143553, filed Dec. 31, 2021, which claims benefit of priority to Chinese Patent Application No. 202111424260.8, filed on Nov. 26, 2021, and which applications are incorporated herein by reference. To the extent appropriate, a claim of priority is made to each of the above disclosed applications.

TECHNICAL FIELD

The present disclosure relates to the field of engineering machinery, and in particular, to a backhoe loader.

BACKGROUND

The backhoe loader, as a multifunctional engineering machine, integrates the characteristic of traditional excavator and loaders, and is suitable for various working conditions. However, in some related technologies, the backhoe loader is tedious and time-consuming in operation, and when the loading operation is switched to the excavating operation, an operator needs to adjust the seat by 180° to face the excavating device for excavating operation. In the excavating process, when it is necessary to move the vehicle, it is necessary to turn the seat to face towards the loading device for driving, and after the vehicle moves in place, it is necessary to turn the seat to face towards the excavating device for excavating operation, so the excavating operation has low efficiency; and the turning angle of the excavating arm can reach 180° at most, rotating is inflexible, the operation range is limited, the seat does not rotate with the excavating arm, and the operation field of view and the sense of control are poor.

SUMMARY

According to one aspect of the present disclosure, a backhoe loader is provided. The backhoe loader includes:

- a vehicle body, including a first vehicle body and a second vehicle body which are connected sequentially;
- a loading device, arranged on the first vehicle body;
- a control platform, arranged on the second vehicle body, the control platform being configured to rotate by 360° relative to the second vehicle body;
- a cab, arranged on a first side of the control platform; and
- an excavating device, arranged on a second side of the control platform opposite to the first side, the excavating device being configured to rotate by 180° relative to the cab.

In some embodiments, the cab includes a first end and a second end which are arranged oppositely, an observation window is arranged at the first end of the cab, and a connection position of the excavating device and the control platform is close to the first end of the cab.

In some embodiments, the excavating device includes an excavating arm and an excavating bucket arranged on the excavating arm; and the excavating arm is configured to be folded, so that the excavating bucket is placed on the control platform and is close to the second end of the cab.

In some embodiments, the excavating device is configured to rotate by 180° relative to the cab, so that the excavating bucket is close to the first end of the cab.

In some embodiments, the control platform is configured to rotate relative to the second vehicle body in an excavating work process of the excavating device so as to drive the observation window and the excavating device to rotate synchronously relative to the second vehicle body.

In some embodiments, the cab includes a first end and a second end which are arranged oppositely, an observation window is arranged at the first end, and when the loading device is located at an upstream of a driving direction of the backhoe loader, a direction from the first end to the second end is consistent with a direction from the first vehicle body to the second vehicle body.

In some embodiments, the cab includes a first end and a second end which are arranged oppositely, an observation window is arranged at the first end, and when the excavating device is located at an upstream of a driving direction of the backhoe loader, a direction from the first end to the second end is consistent with a direction from the second vehicle body to the first vehicle body.

In some embodiments, a center line of the loading device coincides with a center line of the first vehicle body.

In some embodiments, a center line of the control platform is configured to coincide with a center line of the second vehicle body.

In some embodiments, a direction from the cab to the excavating device is perpendicular to a center line extending direction of the second vehicle body.

In some embodiments, the backhoe loader further includes an engine, wherein the engine is arranged on the first vehicle body.

In some embodiments, the backhoe loader further includes a first group of wheels arranged on the first vehicle body and a second group of wheels arranged on the second vehicle body, wherein the engine is in driving connection with the first group of wheels, or the engine is in driving connection with the first group of wheels and the second group of wheels.

In some embodiments, the first vehicle body is hinged with the second vehicle body, or the first vehicle body and the second vehicle body are configured as an integral type structure which are connected integrally.

In some embodiments, the backhoe loader further includes a first slewing bearing, wherein the control platform is connected to the second vehicle body through the first slewing bearing.

In some embodiments, the backhoe loader further includes a second slewing bearing, wherein the excavating device is connected to the control platform through the second slewing bearing.

In some embodiments, the backhoe loader further includes a stabilizer, wherein the stabilizer is arranged on the second vehicle body, and the stabilizer is configured to be unfolded or extend relative to the second vehicle body to support the ground and to be folded relative to the second vehicle body to be suspended above the ground.

Based on the above technical solution, the present disclosure at least has the following beneficial effects:

In some embodiments, the control platform is configured to rotate by 360° relative to the second vehicle body, the excavating device is configured to rotate by 180° relative to the cab, the backhoe loader is configured to realize functions of 360° excavating and bidirectional driving. When the excavating device works, the backhoe loader can be directly moved by folding stabilizers and without changing the position of a seat back and forth, so that the excavating efficiency is improved; and an operator in the cab has a wide field of view, operation feeling is good, the backhoe loader has a compact structure, and the stability of that body is high.

BRIEF DESCRIPTION OF THE ACCOMPANYING DRAWINGS

The accompanying drawings described herein are used to provide further understanding of the present disclosure and constitute a part of the present application. The schematic embodiments of the present disclosure and the description thereof are used to explain the present disclosure, but do not constitute an inappropriate limitation to the present disclosure. In the accompanying drawings.

It should be understood that the dimensions of each part shown in the accompanying drawings are not drawn according to the actual proportional relationship. In addition, the same or similar reference numerals represent the same or similar components.

DETAILED DESCRIPTION OF THE PREFERRED EMBODIMENTS

Exemplary embodiments of the present disclosure are described in detail hereinafter with reference to the accompanying drawings. The description of the exemplary embodiments is merely illustrative and never constitutes any limitation to the present disclosure and application or use thereof. The present disclosure may be implemented in many different forms and is not limited to the embodiments described herein. The embodiments are provided to make the present disclosure thorough and complete and to fully express the scope of the present disclosure to those skilled in the art. It should be noted that unless otherwise specified, relative arrangement of parts and steps, composition of materials, numerical expressions and numerical values illustrated in the embodiments should be explained to be exemplary only, but not be construed as limitations.

The "first", "second" and other similar words do not denote any order, number or importance, but are merely intended to distinguish different parts. The "include" or "comprise" and other similar words mean that elements appearing before the word cover elements listed after the word, but do not exclude the possibility of covering other elements. "Up", "down", "left", "right", or the like is only used to indicate a relative location relationship. When an absolute location of a described object changes, the relative location relationship may also change accordingly.

In the present disclosure, when it is described that a specific device is positioned between a first device and a second device, an intermediate device may or may not be present between the specific device and the first device or the second device. When it is described that the specific device is connected to other devices, the specific device may be directly connected to the other device and may not have the intermediate device, and may not be directly connected to the other device and may have the intermediate device.

All terms used in the present disclosure (including technical terms or scientific terms) have the same meaning as those understood by those of ordinary skill in the technical field which the present disclosure belongs to, unless otherwise specifically defined. It should be understood that terms defined in, for example, a general dictionary should be interpreted as having meanings consistent with the meanings in the context of the related art, and should not be interpreted in an idealized or extremely formal sense unless explicitly defined herein.

Technologies, methods and equipment known to those of ordinary skill in the related field may not be discussed in detail, but, where appropriate, the technologies, methods and equipment should be regarded as a part of the specification.

Some embodiments of the present disclosure provide a backhoe loader for efficient digging, for relieving the problem of lower excavating operation efficiency.

Figure 1:
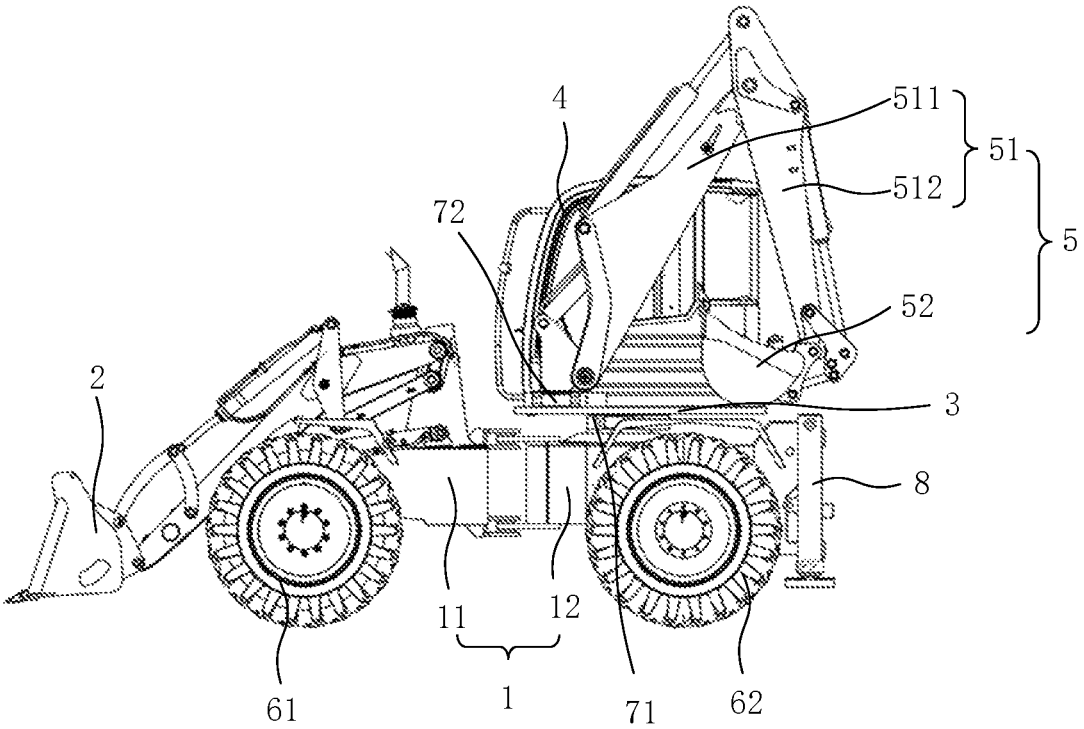
FIG. 1 is a structural schematic diagram of a first side of a backhoe loader according to some embodiments of the present disclosure.
Figure 2:
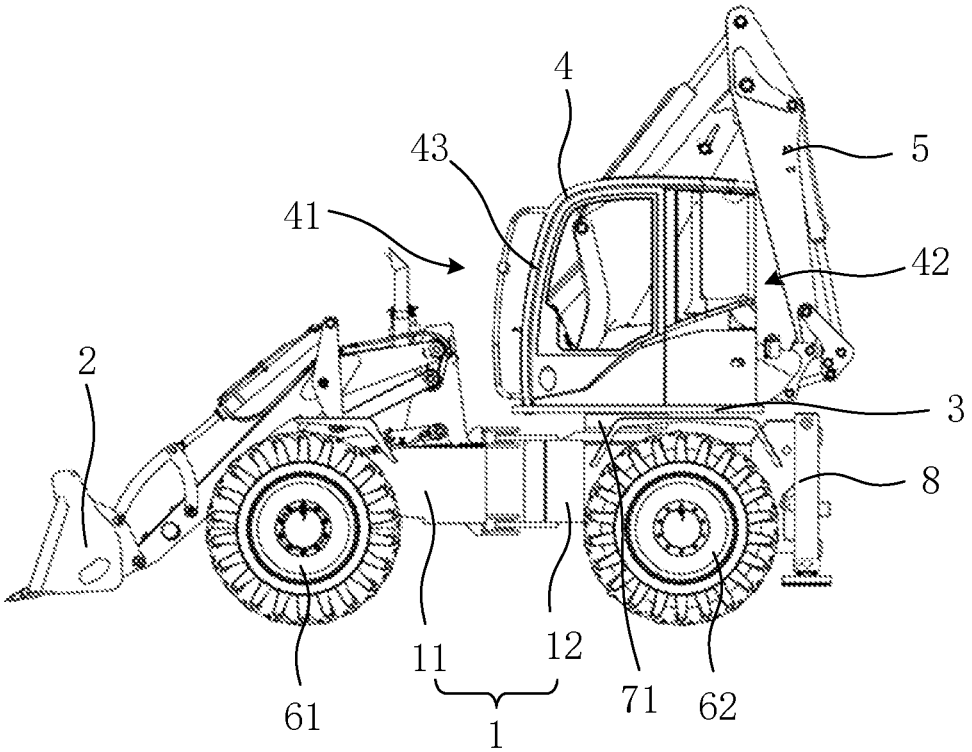
FIG. 2 is a structural schematic diagram of a second side of a backhoe loader according to some embodiments of the present disclosure.

As shown in FIG. 1 and FIG. 2, some embodiments provide a backhoe loader for efficient digging, including a vehicle body 1, a loading device 2, a control platform 3, a cab 4 and an excavating device 5.

The vehicle body 1 includes a first vehicle body 11 and a second vehicle body 12 which are connected sequentially.

The loading device 2 is arranged on the first vehicle body 11.

The control platform 3 is arranged on second vehicle body 12, and the control platform 3 is configured to rotate by 360° relative to second vehicle body 12.

Figure 3:
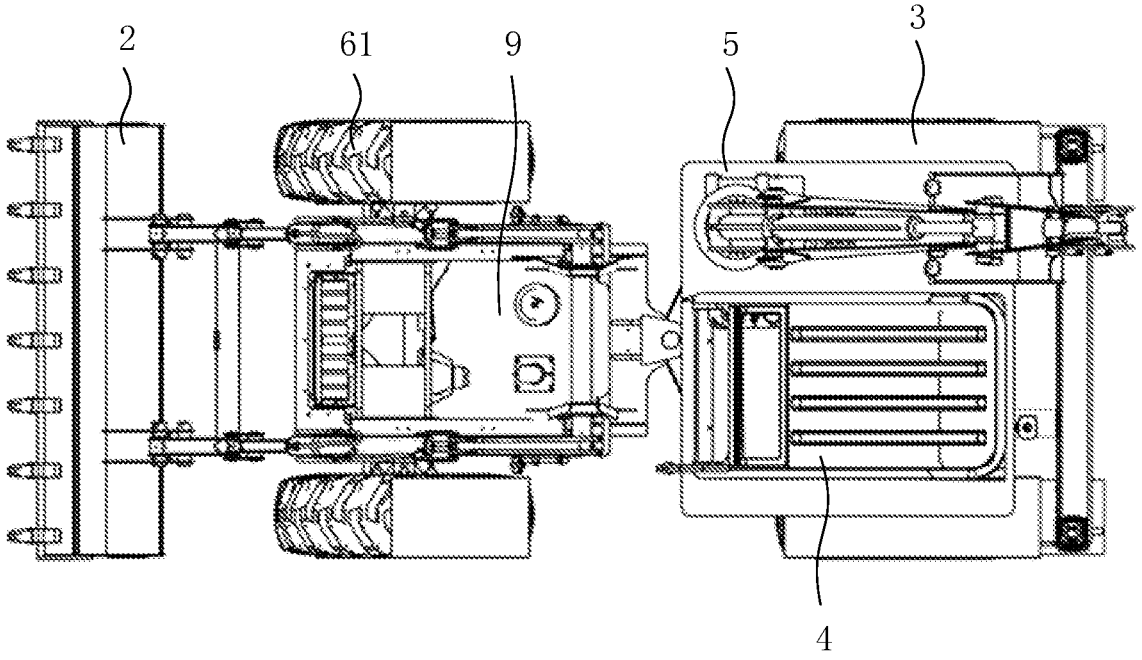
FIG. 3 is a schematic top view of a backhoe loader according to some embodiments of the present disclosure.

As shown in FIG. 3, the cab 4 is arranged on a first side of the control platform 3. The excavating device 5 is arranged on a second side of the control platform 3 opposite to the first side, and the excavating device 5 is configured to rotate by 180° relative to the cab 4.

The first side and the second side of the control platform 3 are two sides along the straight driving direction of the backhoe loader. Traveling of the backhoe loader includes straight traveling and turning traveling.

In the embodiments of the present disclosure, the vehicle body 1 of the backhoe loader includes a first vehicle body 11 and a second vehicle body 12, a loading device 2 is arranged on the first vehicle body 11, a control platform 3 is arranged on the second vehicle body 12, the control platform 3 is configured to rotate by 360° relative to the second vehicle body 12, forward driving and reverse driving of the backhoe loader can be realized, the functions of 360° omnibearing excavating operation can be realized, the operation field of view and the excavating slewing angle are large, rotating is flexible, and the sense of control is good.

Figure 5:
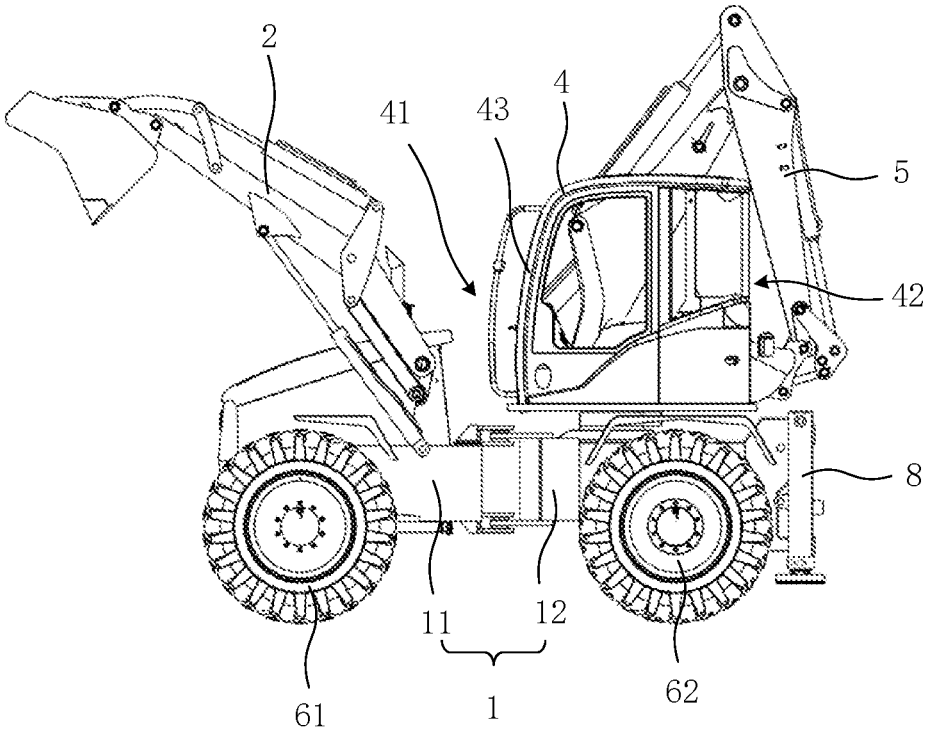
FIG. 5 is a schematic diagram of a working state of a loading device of a backhoe loader according to some embodiments of the present disclosure.
Figure 6:
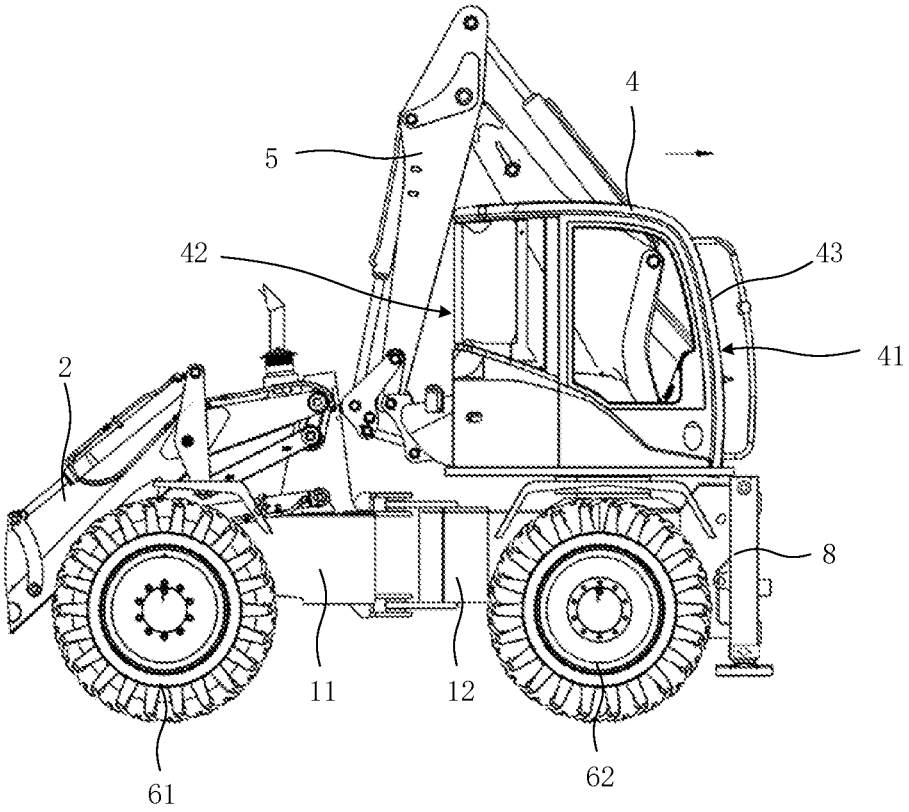
FIG. 6 is a schematic diagram of an excavating device at an upstream in the driving process of a backhoe loader according to some embodiments of the present disclosure.

As shown in FIG. 1, FIG. 2 and FIG. 5, when the control platform 3 is located at the 0° position, the backhoe loader can perform loading operation or forward driving. As shown in FIG. 6, when the control platform 3 is located at the 180° position, the backhoe loader can perform reverse driving. The 360° position of the control platform 3 coincides with the 0° position.

When the loading device 2 is located at the upstream of the driving direction of the backhoe loader relative to the excavating device 5, it is the forward driving of the backhoe loader. When the excavating device 5 is located at the upstream of the driving direction of the backhoe loader relative to the loading device 2, it is the reverse driving of the backhoe loader.

The cab 4 is arranged on the first side of the control platform 3, the excavating device 5 is arranged on the second side of the control platform 3 relative to the first side, the overall layout is symmetrical, the structure is compact, and stability and reliability can be achieved when the backhoe loader works. The excavating device 5 can rotate by 180° relative to the cab 4. The excavating device 5 can rotate at the position between 0° and 180° relative to the cab 4 for switching the working state and the non-working state of the excavating device 5.

Figure 7:
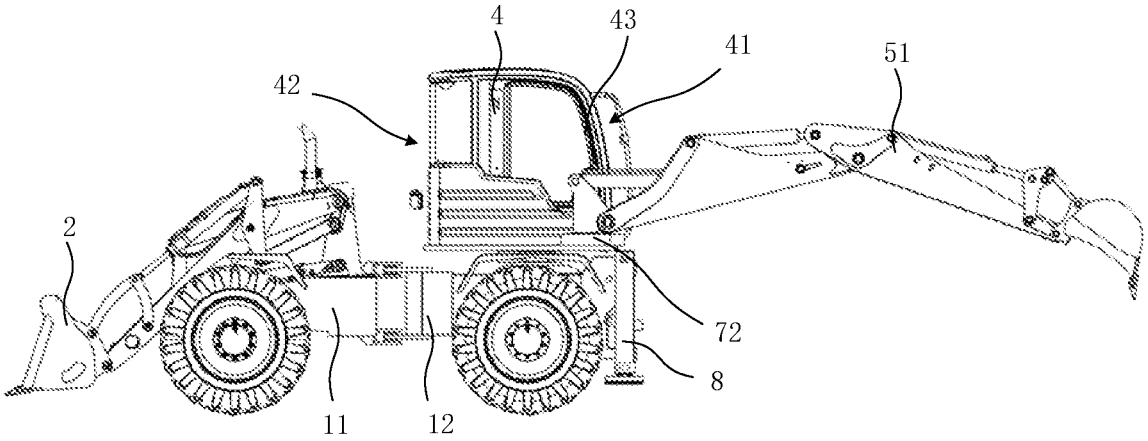
FIG. 7 is a schematic diagram of a working state of an excavating device of a backhoe loader according to some embodiments of the present disclosure.

As shown in FIG. 7, when the excavating device 5 is at the 0° position, the excavating device 5 can perform excavating operation, the excavating device 5 is in the working state, and the backhoe loader can drive reversely. As shown in FIG. 1, FIG. 2, FIG. 5 and FIG. 6, when the excavating device 5 is at the 180° position, the excavating arm 51 of the excavating device 5 can be folded, the excavating bucket 52 of the excavating device 5 is placed on the control platform 3, the excavating device 5 is in the non-working state, and the backhoe loader may drive forwards and may also drive reversely.

When the excavating device 5 performs excavating operation, the control platform 3 can rotate between 0° and 360° relative to the second vehicle body 12 so as to realize 360° excavating operation of the backhoe loader.

In conclusion, the backhoe loader provided by the embodiments of the present disclosure can realize functions of 360° excavating and bidirectional driving. When the excavating device 5 works, the backhoe loader can be directly moved by folding stabilizers and without changing the position of a seat back and forth, so that the excavating efficiency is improved; and an operator in the cab 4 has a wide field of view, operation feeling is good, the backhoe loader has a compact structure, and the stability of that body is high.

In some embodiments, the cab 4 includes a first end 41 and a second end 42 which are arranged oppositely, an observation window 43 is arranged at the first end 41 of the cab 4, and a connection position of the excavating device 5 and the control platform 3 is close to the first end 41 of the cab 4.

When the loading device 2 performs loading operation, the control platform 3 is located at the 0° position, the first end 41 of the cab 4 is closer to the loading device 2 relative to the second end 42, and an operator in the cab 4 can observe the operation state of the loading device 2 through the observation window 43.

When the excavating device 5 performs excavating operation, the control platform 3 can rotate relative to the second vehicle body 12 to drive the excavating device 5 and the control platform 3 to rotate synchronously, the operator in the cab 4 can observe the operation state of the excavating device 5 through the observation window 43, and the field of view of the operator is wide.

A seat is arranged in the cab 4, the seat is arranged at a position close to the observation window 43 and faces towards the first end 41 of the cab 4, and the operator sits on the seat, operates the backhoe loader, observes the external situation through the observation window 43 and observes the working state of the loading device 2 or the excavating device 5.

In some embodiments, as shown in FIG. 1 and FIG. 2, the excavating device 5 includes an excavating arm 51 and an excavating bucket 52 arranged on the excavating arm 51, the excavating arm 51 is configured to be folded to place the excavating bucket 52 on the control platform 3 close to the second end 42 of the cab 4.

When the digging device 5 is in the non-working state, the excavating arm 51 is folded, and the excavating bucket 52 is placed on the control platform 3 and close to the second end 42 of the cab 4. The control platform 3 supports the excavating bucket 52 to avoid the swing problem of the excavating arm 51 when the excavating bucket 52 is in the hanging state, so the stability of the backhoe loader is improved.

In some embodiments, when the excavating arm 51 is folded and the excavating bucket 52 is placed on the control platform 3 and close to the second end 42 of the cab 4, the excavating device 5 is configured to rotate by 180° relative to the cab 4, so that the excavating bucket 52 is close to the first end 41 of the cab 4, and the excavating arm 51 is unfolded at the first end 41 of the cab 4 for excavating operation.

The excavating device 5 can be switched 0° and 180°. When the excavating device 5 is at the 0° position, the excavating device 5 may perform excavating operation and the backhoe loader may drive reversely. When the excavating device 5 slews to the 180° position, the excavating arm 51 can be folded, and the excavating bucket 52 is placed on the control platform 3 and close to the second end 42 of the cab 4.

In some embodiments, the control platform 3 is configured to rotate relative to the second vehicle body 12 when the excavating device 5 performs excavating operation so as to drive the observation window 43 and the excavating device 5 to rotate synchronously relative to the second vehicle body 12.

The control platform 3 drives the observation window 43 and the excavating device 5 to rotate by 360° synchronously relative to the second vehicle body 12, so that 360° omnibearing excavating operation of the excavating device 5 can be realized, the operator rotates along with the control platform 3 in the cab 4, the field of view is wide, and the sense of control is good.

As shown in FIG. 2, in some embodiments, the cab 4 includes a first end 41 and a second end 42 which are arranged oppositely, an observation window 43 is arranged at the first end 41, and when the loading device 2 is located at the upstream of the driving direction of the backhoe loader relative to the excavating device 5, the first end 41 of the cab 4 is located at the upstream of the driving direction of the backhoe loader relative to the second end 42. The direction from the first end 41 to the second end 42 is substantially consistent with the direction from the first vehicle body 11 to the second vehicle body 12.

As shown in FIG. 6, in some embodiments, the cab 4 includes a first end 41 and a second end 42 which are arranged oppositely, an observation window 43 is arranged at the first end 41 of the cab 4, and when the excavating device 5 is located at the upstream of the driving direction of the backhoe loader relative to the loading device 2, the first end 41 of the cab 4 is located at the upstream of the driving direction of the backhoe loader relative to the second end 42. The direction from the first end 41 of the cab 4 to the second end 42 of the cab 4 is substantially consistent with the direction from the second vehicle body 12 to the first vehicle body 11.

When the backhoe loader drives, the first end 41 of the cab 4 is always located at the upstream of the driving direction relative to the second end 42.

In some embodiments, a center line of the loading device 2 coincides with a center line of the first vehicle body 11.

In some embodiments, a center line of the vehicle body 1 extends along the direction from the first vehicle body 11 to the second vehicle body 12, and a center line of the loading device 2 coincides with a center line of the vehicle body 1.

In some embodiments, the control platform 3 is configured to be able to realize that the center line of the control platform 3 coincides with the centerline of the second vehicle body 12 in the rotation process relative to the second vehicle body 12. The center line of the loading device 12 coincides with the center line of the vehicle body 1.

In some embodiments, a center line of the vehicle body 1 extends along the direction from the first vehicle body 11 to the second vehicle body 12, and a center line of the control platform 3 coincides with a center line of the vehicle body 1.

The direction from the first vehicle body 11 to the second vehicle body 12 is: the direction from the first vehicle body 11 to the second vehicle body 12 when the first vehicle body 11 and the second vehicle body 12 are located on the same straight line.

When the backhoe loader drives along the straight line, the first vehicle body 11 and the second vehicle body 12 are located on the same straight line, the center line of the control platform 3 coincides with the center line of the vehicle body 1, and the center line of the loading device 2 also coincides with the center line of the vehicle body 1.

When the center line of the control platform 3 coincides or does not coincide with the center line of the vehicle body 1, the excavating device 5 can all perform excavating operation.

In some embodiments, the direction from the cab 4 to the excavating device 5 is perpendicular to the center line extending direction of the second vehicle body 12. The center line of the loading device 12 coincides with the center line of the vehicle body 1.

In some embodiments, the direction from the cab 4 to the excavating device 5 is perpendicular to the direction from the first vehicle body 11 to the second vehicle body 12.

In some embodiments, as shown in FIG. 3, the backhoe loader further includes an engine 9, wherein the engine 9 is arranged on the first vehicle body 11.

The engine 9 and other power systems are arranged at the first vehicle body 11, the cab 4 and the excavating device 5 are arranged on the second vehicle body 12, and the excavating device 5 can be adjusted to the lowest state, so that the highest position is lower than the highest position of the cab 4, the overall height of the product is reduced, the passing property of the whole machine is improved, and transition movement is facilitated.

In some embodiments, the backhoe loader further includes a first group of wheels 61 and a second group of wheels 62, the first group of wheels 61 is arranged on the first vehicle body 11, the second group of wheels 62 is arranged on the second vehicle body 12, the engine 9 is in driving connection with the first group of wheels 61, or the engine 9 is in driving connection with the first group of wheels 61 and the second group of wheels 62.

A front axle and the engine 9 are mounted on the first vehicle body 11, and a rear axle is mounted on the second vehicle body 12. The power system includes the engine 9, a gearbox and the like. The engine 9 is connected to the gearbox, and the power system drives the front axle and the rear axle to realize four-wheel or two-wheel driving.

Figure 4:
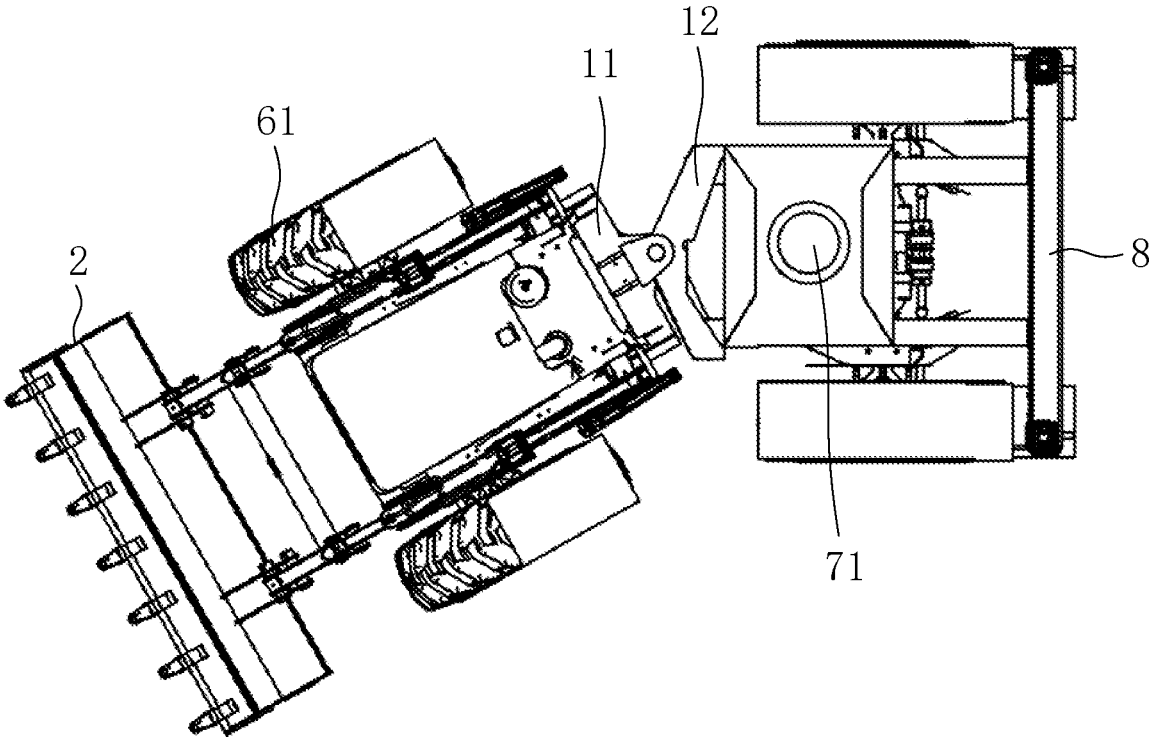
FIG. 4 is a schematic diagram of a turning state of a backhoe loader according to some embodiments of the present disclosure.

In some embodiments, as shown in FIG. 4, the first vehicle body 11 is hinged with the second vehicle body 12, and a hinged vehicle frame is adopted, so that the minimum turning radius can be achieved and steering in a narrow place is realized; furthermore, the front axle no longer needs to be provided with a steering mechanism, so the structure is simpler and the cost of the whole machine is effectively reduced.

In some embodiments, the first vehicle body 11 and the second vehicle body 12 are configured to be connected into an integrated structure. The vehicle body 1 is of an integrated type, and at this time, at least one of the front axle and the rear axle needs to be a steering axle, so that driving and steering are realized.

In some embodiments, the backhoe loader further includes a first slewing bearing 71, and the control platform 3 is connected to the second vehicle body 12 through the first slewing bearing 71.

The first slewing bearing 71 is used to support the whole control platform 3, which includes a cab 4 and an excavating device 5, and the first slewing bearing 71 is a main body of a slewing control mechanism, so that 360° slewing can be realized, and the excavating device 5 can realize 360° omnibearing excavating operation.

In some embodiments, the backhoe loader further includes a second slewing bearing 72, and the excavating device 5 is connected to the control platform 3 through the second slewing bearing 72. The second slewing bearing 72 has slewing and limiting effects, so that the excavating device 5 is switched between 0° and 180°. When the excavating device 5 is at the 0° position, the excavating device 5 can perform excavating operation and the backhoe loader can drive reversely. When the excavating device 5 slews to the 180° position, the excavating arm 51 is folded, the excavating bucket 52 is placed on the control platform 3, and the backhoe loader can drive forwards or reversely. The second slewing bearing 72 can rapidly switch the state of the whole machine, and the first slewing bearing 71 can be adapted to enable the excavating device 5 to realize multi-angle excavating operation, so that the requirements of various working conditions on the engineering vehicle are met, and the excavating efficiency is improved.

In some embodiments, the backhoe loader further includes a stabilizer 8, wherein the stabilizer 8 is arranged on the second vehicle 12, and the stabilizer 8 is configured to be unfolded or extend relative to the second vehicle body 12 to support the ground and to be folded relative to the second vehicle body 12 to be suspended above the ground.

Figure 8:
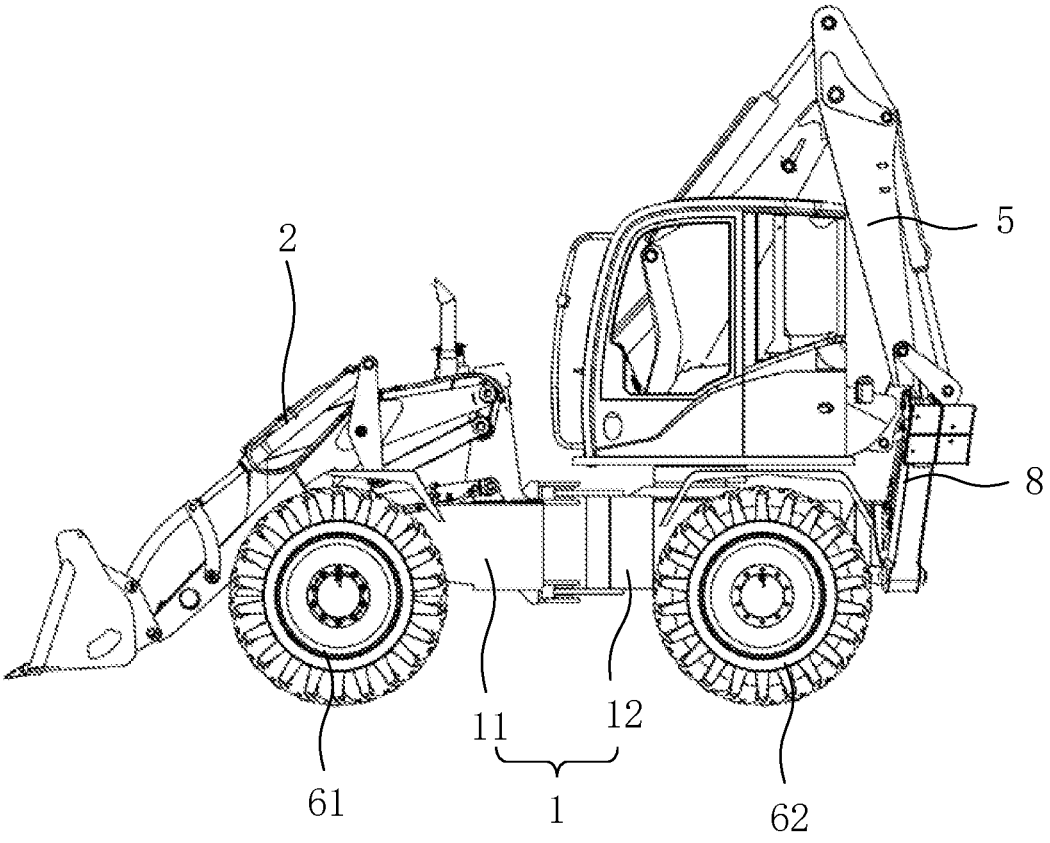
FIG. 8 is a structural schematic diagram of a backhoe loader with a wing-spreading type stabilizer according to some embodiments of the present disclosure.

Optionally, the stabilizer 8 includes an H-shaped stabilizer (as shown in FIG. 1 to FIG. 7), a wing-spreading type stabilizer (as shown in FIG. 8) and the like.

In some embodiments, the backhoe loader further includes a limiting device, wherein the limiting device includes a mechanical limiting device and an electric control limiting device, and by setting the limiting device, when the stabilizer 8 is not completely folded, the machine body cannot move.

As shown in FIG. 1 and FIG. 2, in some specific embodiments, the backhoe loader includes a vehicle body 1, wherein the vehicle body 1 adopts a hinged structure, the vehicle body 1 includes a first vehicle body 11 and a second vehicle body 12, a loading device 2 is arranged on the first vehicle body 11, and the second vehicle body 12 supports the control platform 3 through the first slewing bearing 71.

When the backhoe loader is at the initial state, the center line of the loading device 2 coincides with the center line of the front-rear direction of the vehicle body 1, the engine 9 is located at the center position of the loading device 2, the loading device 2 adopts an eight-connecting-rod mechanism, and a scraper bucket of the loading device 2 can realize automatic leveling.

The center line of the control platform 3 coincides with the center line of the front-rear direction of the vehicle body, the bottom of the control platform 3 is connected to the second vehicle body 12 through the first slewing bearing 71, a cab 4 is arranged on one side of the top of the control platform 3 along the driving direction of the backhoe loader, and a second slewing bearing 72 and an excavating device 5 are arranged on the other side of the top of the control platform 3 along the driving direction of the backhoe loader.

When the excavating device 5 is at the 0° position, the excavating device 5 may perform excavating operation and the backhoe loader may drive reversely. When the excavating device 5 slews to the 180° position, the excavating arm 51 can be folded, the excavating bucket 52 is placed on the control platform 3 and close to the second end 42 of the cab 4, and the backhoe loader may drive forwards or reversely.

When the excavating device 5 is at the initial state, the excavating device 5 is located at the 180° position.

The excavating device 5 includes an excavating arm 51 and an excavating bucket 52. The excavating arm 51 includes a first excavating arm 511 and a second excavating arm 512, a first end of the first excavating arm 511 is hinged with the second slewing bearing 72, a second end of the first excavating arm 511 is hinged with a first end of the second excavating arm 512, and the second end of the second excavating arm 512 is hinged with the excavating bucket 52. The excavating device 5 further includes a first oil cylinder, a second oil cylinder and a third oil cylinder, wherein the first oil cylinder is arranged on the second slewing bearing 72 and is in driving connection with the first excavating arm 511, the second oil cylinder is arranged on the first excavating arm 511 and is in driving connection with the second excavating arm 512, and the third oil cylinder is arranged on the second excavating arm 512 and is in driving connection with the excavating bucket 52. When the first oil cylinder is completely contracted, the second oil cylinder and the third oil cylinder are completely extended, the excavating arm 51 is folded, and the excavating bucket 52 can be placed on the control platform 3 or the rear end of the backhoe loader, so that the transportation stability is improved.

The first slewing bearing 71 is responsible for supporting the whole control platform 3, which includes a cab 4 and an excavating device 5, and the first slewing bearing 71 is a main body of a slewing control mechanism, so that 360° slewing can be realized, and omnibearing excavating operation of the excavating device 5 can be realized.

The second slewing bearing 72 has slewing and limiting effects, so that the excavating device 5 can rotate between 0° position and 180° position. Generally, the excavating device 5 is switched between 0° position and 180° position. When the excavating device 5 is at the 0° position, the excavating device 5 can perform excavating operation and the backhoe loader can drive reversely. When the excavating device 5 slews to the 180° position, the excavating arm 51 is retracted, the excavating bucket 52 is placed on the control platform 3, and the backhoe loader can drive forwards or reversely.

In conclusion, the backhoe loader includes a hinged vehicle body 1, a loading device 2, a control platform 3, an excavating device 5 and a cab 4. The control platform 3 is connected to the vehicle body 1 through the first slewing bearing 71, and the first slewing bearing 71 can be adapted to realize the 360° omnibearing excavating and bidirectional driving functions of the backhoe loader, so that the operation is simple, convenient and rapid, flexible operation construction and high working efficiency are achieved. The excavating device 5 adopts the second slewing bearing 72 to be connected to the control platform 3, and the second slewing bearing 72 has a limiting function and is adapted to switch the working state of the whole machine, thereby ensuring compactness and flexibility of the whole machine during normal driving and loading operation and realizing comfortability and high efficiency of the excavating operation.

The backhoe loader provided by the embodiments of the present disclosure can improve the shortcomings of the excavating operation, the whole machine has a compact structure and is flexible to move, high-efficiency operation is achieved, the operator in the cab 4 is convenient to operate and has wide field of view and good sense of control, and the problems that the related backhoe loader has a narrow range of excavating operation and small excavating slewing angle, and the operator in the cab 4 has poor field of view, is difficult to operate and has low operation efficiency are solved.

Based on the embodiments of the present disclosure, the technical features of one of the embodiments can be beneficially combined with one or more of other embodiments without explicit negation.

Although some specific embodiments of the present disclosure have been illustrated in detail through the examples, those skilled in the art should understand that the above examples are merely for illustration, but not intended to limit the scope of the present disclosure. Those skilled in the art should understand that the above embodiments may be modified or part of technical features may be equivalently replaced without departing from the scope and spirit of the present disclosure. The scope of the present disclosure is defined by the appended claims.

The invention claimed is:

1. A backhoe loader, comprising:

a vehicle body, comprising a first vehicle body and a second vehicle body which are connected sequentially;

a loading device, arranged on the first vehicle body;

a control platform, arranged on the second vehicle body and configured to rotate by 360° relative to the second vehicle body;

a cab, arranged on a first side of the control platform; and an excavating device, arranged on a second side of the control platform opposite to the first side, the excavating device being configured to rotate by 180° relative to the cab;

wherein the cab comprises a first end and a second end which are arranged oppositely, an observation window is arranged at the first end of the cab, and a connection position of the excavating device to the control platform is close to the first end of the cab;

wherein the excavating device comprises an excavating arm and an excavating bucket arranged on the excavating arm; and the excavating arm is foldable, so that the excavating bucket is arranged on the control platform and is close to the second end of the cab;

wherein the excavating device is configured to rotate by 180° relative to the cab, so that the excavating bucket is close to the first end of the cab;

when the loading device performs loading operation, the first end of the cab is closer to the loading device relative to the second end, the excavating device is in the non-working state, the excavating arm is folded, and the excavating bucket is placed directly on the control platform and close to the second end of the cab; and when the excavating device performs excavating operation, the first end of the cab is closer to the excavating device relative to the second end, the excavating device is in the working state, the excavating arm is unfolded, and the excavating bucket is close to the first end of the cab.

2. The backhoe loader according to claim 1, wherein the control platform is configured to rotate relative to the second vehicle body in an excavating work process of the excavating device so as to drive the observation window to rotate synchronously with the excavating device relative to the second vehicle body.

3. The backhoe loader according to claim 1, wherein the cab comprises a first end and a second end which are arranged oppositely, an observation window is arranged at the first end, and when the loading device is located at an upstream of a driving direction of the backhoe loader, a direction from the first end to the second end is consistent with a direction from the first vehicle body to the second vehicle body.

4. The backhoe loader according to claim 1, wherein the cab comprises a first end and a second end which are arranged oppositely, an observation window is arranged at the first end, and when the excavating device is located at an upstream of a driving direction of the backhoe loader, a direction from the first end to the second end is consistent with a direction from the second vehicle body to the first vehicle body.

5. The backhoe loader according to claim 1, wherein a center line of the loading device coincides with a center line of the first vehicle body.

6. The backhoe loader according to claim 1, wherein a center line of the control platform is configured to coincide with a center line of the second vehicle body.

7. The backhoe loader according to claim 1, wherein a direction from the cab to the excavating device is perpendicular to a center line extending direction of the second vehicle body.

8. The backhoe loader according to claim 1, further comprising an engine, wherein the engine is arranged on the first vehicle body.

9. The backhoe loader according to claim 8, further comprising a first group of wheels arranged on the first vehicle body and a second group of wheels arranged on the second vehicle body, wherein the engine is in driving connection with the first group of wheels, or the engine is in driving connection with the first group of wheels and the second group of wheels.

10. The backhoe loader according to claim 1, wherein the first vehicle body is hinged with the second vehicle body, or the first vehicle body and the second vehicle body are configured as an integral type structure which are connected integrally.

11. The backhoe loader according to claim 1, further comprising a first slewing bearing, wherein the control platform is connected to the second vehicle body through the first slewing bearing.

12. The backhoe loader according to claim 11, further comprising a second slewing bearing, wherein the excavating device is connected to the control platform through the second slewing bearing.

13. The backhoe loader according to claim 1, further comprising a stabilizer, wherein the stabilizer is arranged on the second vehicle body, and the stabilizer is configured to be unfolded or extend relative to the second vehicle body to support the ground and to be folded relative to the second vehicle body to be suspended above the ground.

* * * * *